US011176869B2

(12) United States Patent
Jia et al.

(10) Patent No.: US 11,176,869 B2
(45) Date of Patent: Nov. 16, 2021

(54) METHOD FOR DRIVING DISPLAY DEVICE AND DRIVER

(71) Applicants: Chengdu BOE Optoelectronics Technology Co., Ltd., Chengdu (CN); BOE TECHNOLOGY GROUP CO., LTD., Beijing (CN)

(72) Inventors: Qun Jia, Beijing (CN); Chang Zhang, Beijing (CN)

(73) Assignees: Chengdu BOE Optoelectronics Technology Co., Ltd., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/035,946

(22) Filed: Sep. 29, 2020

(65) Prior Publication Data

US 2021/0264840 A1 Aug. 26, 2021

(30) Foreign Application Priority Data

Feb. 20, 2020 (CN) ..... 202010103814.3

(51) Int. Cl.
*G09G 3/20* (2006.01)

(52) U.S. Cl.
CPC ..... *G09G 3/2074* (2013.01); *G09G 3/2003* (2013.01); *G09G 2300/0452* (2013.01); *G09G 2320/0233* (2013.01); *G09G 2320/0242* (2013.01)

(58) Field of Classification Search
CPC ..... G09G 3/2003; G09G 3/2074; G09G 2300/0452; G09G 3/32–3291
See application file for complete search history.

(56) References Cited

U.S. PATENT DOCUMENTS

2015/0015590 A1* 1/2015 Jeong ..... G09G 3/2003 345/502
2019/0164477 A1* 5/2019 Yim ..... G09G 3/3225

OTHER PUBLICATIONS

Second Office Action for CN Patent Application No. 202010103814.3, dated Apr. 6, 2021.
Limin, et al., "A Three-primary Multi-sub Pixel Arrangement", Sep. 30, 2017.

* cited by examiner

*Primary Examiner* — Gene W Lee
(74) *Attorney, Agent, or Firm* — Thomas | Horstemeyer, LLP

(57) ABSTRACT

The present disclosure provides a method for driving a display device and a driver. The method includes obtaining image data; determining whether the image pixels are detail pixels according to the image data; determining a plurality of screen pixel groups; and driving the screen pixels for display.

10 Claims, 10 Drawing Sheets

METHOD FOR DRIVING DISPLAY DEVICE AND DRIVER

CROSS-REFERENCE TO RELATED APPLICATION

The present application is based on and claims priority to Chinese Patent Application No. 202010103814.3 filed on Feb. 20, 2020, the contents of which are incorporated reference in their entirety herein.

TECHNICAL FIELD

The present disclosure relates to display technologies and, in particular, to a method for driving a display device and a driver.

BACKGROUND

OLED display devices (e.g., organic light emitting displays and organic electroluminescent devices) have advantages of high transmittance, super thinness, high-definition, high brightness, high contrast, fast response, low energy consumption, flexible display, etc., and thus, they are widely applied.

OLED display devices can use a GRGB sub-pixel arrangement instead of Real RGB sub-pixel arrangement. For example, sub-pixels can be arranged in a Diamond pixel arrangement and SPR (Sub-Pixel Render, a sub-pixel borrowing algorithm) can be used to display images. However, when displaying single pixel dot images or single pixel line images, the SPR algorithm cannot achieve desired effects.

The above information disclosed in the background section is only used to enhance the understanding of the background of the present disclosure, so it may include information that does not constitute prior art known to those of ordinary skill in the art.

SUMMARY

Embodiments of the present disclosure provide the following technical solutions.

According to a first aspect of the present disclosure, there is provided a method for driving a display device. The display device includes a plurality of screen pixels arranged in an array, where the plurality of screen pixels include a plurality of first screen pixels and a plurality of second screen pixels, each of the first screen pixels includes a first sub-screen pixel and a second sub-screen pixel, and each of the second screen pixels includes a first sub-screen pixel and a third sub-screen pixel.

In any screen pixel row, first screen pixels and second screen pixels are alternately arranged, individual first sub-screen pixels are arranged along a straight line, and a second sub-screen pixel or a third sub-screen pixel is arranged between any two adjacent first sub-screen pixels.

In any screen pixel column, first screen pixels and second screen pixels are alternately arranged, and individual first sub-screen pixels are arranged along a straight line.

The method for driving the display device includes:

obtaining image data, wherein the image data includes color parameters of image pixels corresponding to the plurality of screen pixels one to one;

determining whether the image pixels are detail pixels according to the image data, wherein each of the detail pixels is an image pixel for displaying a single pixel dot pattern or a single pixel line pattern;

determining a plurality of screen pixel groups, wherein any one of the screen pixel groups includes two of the screen pixels adjacently arranged in a same row, and a screen pixel corresponding to each of the detail pixels is in the screen pixel group; and driving the screen pixels for display, wherein a first sub-screen pixel located between a second sub-screen pixel and a third sub-screen pixel in any one of the screen pixel groups is used for emitting light, and another first sub-screen pixel in the any one of the screen pixel groups does not emit light.

According to an exemplary embodiment of the present disclosure, obtaining image data includes:

obtaining the color parameters of the image pixels corresponding to the screen pixels one to one, wherein a color parameter of any one of the pixel images includes a first color grayscale value, a second color grayscale value, and a third color grayscale value.

According to an exemplary embodiment of the present disclosure, determining whether the image pixels are detail pixels according to the image data includes:

for any three adjacently arranged image pixels among the image pixels in each row, comparing a color parameter of a middle image pixel which is in the middle of the three adjacently arranged image pixels with color parameters of other two image pixels of the three adjacently arranged image pixels;

if at least one of differences between the first color grayscale value, the second color grayscale value and the third color grayscale value of the middle image pixel and the first color grayscale value, the second color grayscale value and the third color grayscale value of a preceding image pixel satisfies a preset threshold, and at least one of differences between the first color grayscale value, the second color grayscale value and the third color grayscale value of the middle image pixel and the first color grayscale value, the second color grayscale value and the third color grayscale value of a following image pixel satisfies a preset threshold, determining that the middle image pixel is a detail pixel;

for any three adjacently arranged image pixels among the image pixels in each column, comparing a color parameter of a middle image pixel which is in the middle of the three adjacently arranged image pixels with color parameters of other two image pixels of the three adjacently arranged image pixels; and if at least one of differences between the first color grayscale value, the second color grayscale value and the third color grayscale value of the middle image pixel and the first color grayscale value, the second color grayscale value and the third color grayscale value of an upper image pixel satisfies a preset threshold, and at least one of differences between the first color grayscale value, the second color grayscale value and the third color grayscale value of the middle image pixel and the first color grayscale value, the second color grayscale value and the third color grayscale value of a lower image pixel satisfies a preset threshold, determining that the middle image pixel is a detail pixel.

According to an exemplary embodiment of the present disclosure, for any three adjacently arranged image pixels among the image pixels in each row, comparing a color parameter of a middle image pixel which is in the middle of the three adjacently arranged image pixels with color parameters of other two image pixels of the three adjacently arranged image pixels includes:

comparing $G_1(i, j+1)$ with $G_1(i, j)$ and $G_1(i, j+2)$, comparing $G_2(i, j+1)$ with $G_2(i, j)$ and $G_2(i, j+2)$, and comparing $G_3(i, j+1)$ with $G_3(i, j)$ and $G_3(i, j+2)$;

wherein:

i is any integer between 1 and I;

I is a total number of rows of the image pixels;

j is any integer between 1 and J−2;

J is a total number of columns of the image pixels;

$G_1(i, j+1)$ is the first color grayscale value of an image pixel A(i, j+1) in i-th row and (j+1)-th column;

$G_2(i, j+1)$ is the second color grayscale value of the image pixel A(i, j+1);

$G_3(i, j+1)$ is the third color grayscale value of the image pixel A(i, j+1);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i, j+2)$ is the first color grayscale value of an image pixel A(i, j+2) in i-th row and (j+2)-th column;

$G_2(i, j+2)$ is the second color grayscale value of the image pixel A(i, j+2);

$G_3(i, j+2)$ is the third color grayscale value of the image pixel A(i, j+2);

wherein if at least one of differences between the first color grayscale value, the second color grayscale value and the third color grayscale value of the middle image pixel and the first color grayscale value, the second color grayscale value and the third color grayscale value of a preceding image pixel satisfies a preset threshold, and at least one of differences between at least one of the first color grayscale value, the second color grayscale value and the third color grayscale value of the middle image pixel and the first color grayscale value, the second color grayscale value and the third color grayscale value of a following image pixel satisfies a preset threshold, determining that the middle image pixel is a detail pixel, includes:

if at least one of $|G_1(i, j+1)-G_1(i, j)|>G_1^{ref}$, $|G_2(i, j+1)-G_2(i, j)|>G_2^{ref}$ and $|G_3(i, j+1)-G_3(i, j)|>G_3^{ref}$ is satisfied, and at least one of $|G_1(i, j+1)-G_1(i, j+2)|>G_1^{ref}$, $|G_2(i, j+1)-G_2(i, j+2)|>G_2^{ref}$ and $|G_3(i, j+1)-G_3(i, j+2)|>G_3^{ref}$ is satisfied, determining that the image pixel A(i, j+1) is the detail pixel;

wherein $G_1^{ref}$ is a first color grayscale threshold, $G_2^{ref}$ is a second color grayscale threshold, and $G_3^{ref}$ is a third color grayscale threshold.

According to an exemplary embodiment of the present disclosure, for any three adjacently arranged image pixels among the image pixels in each column, comparing a color parameter of a middle image pixel which is in the middle of the three adjacently arranged image pixels with color parameters of other two image pixels of the three adjacently arranged image pixels, includes:

comparing $G_1(i+1, j)$ with $G_1(i, j)$ and $G_1(i+2)$, comparing $G_2(i+1, j)$ with $G_2(i, j)$ and $G_2(i+2, j)$, and comparing $G_3(i+1, j)$ with $G_3(i, j)$ and $G_3(i+2, j)$;

wherein:

i is any integer between 1 and I−2;

I is a total number of rows of the image pixels;

j is any integer between 1 and J;

J is a total number of columns of the image pixels;

$G_1(i+1, j)$ is the first color grayscale value of an image pixel A(i+1, j) in (i+1)-th row and j-th column;

$G_2(i+1, j)$ is the second color grayscale value of the image pixel A(i+1, j);

$G_3(i+1, j)$ is the third color grayscale value of the image pixel A(i+1, j);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i+2, j)$ is the first color grayscale value of an image pixel A(i+2, j) in (i+2)-th row and j-th column;

$G_2(i+2, j)$ is the second color grayscale value of the image pixel A(i+2, j);

$G_3(i+2, j)$ is the third color grayscale value of the image pixel A(i+2, j);

wherein if at least one of differences between the first color grayscale value, the second color grayscale value and the third color grayscale value of the middle image pixel and the first color grayscale value, the second color grayscale value and the third color grayscale value of an upper image pixel satisfies a preset threshold, and at least one of differences between the first color grayscale value, the second color grayscale value and the third color grayscale value of the middle image pixel and the first color grayscale value, the second color grayscale value and the third color grayscale value of a lower image pixel satisfies a preset threshold, determining that the middle image pixel is a detail pixel, includes:

if at least one of $|G_1(i+1, j)-G_1(i, j)|>G_1^{ref}$, $|G_2(i+1, j)-G_2(i, j)|>G_2^{ref}$ and $|G_3(i+1, j)-G_3(i, j)|>G_3^{ref}$ is satisfied, and at least one of $|G_1(i+1, j)-G_1(i+2, j)|>G_1^{ref}$, $|G_2(i+1, j)-G_2(i+2, j)|>G_2^{ref}$ and $|G_3(i+1, j)-G_3(i+2, j)|>G_3^{ref}$ is satisfied, determining that the image pixel A(i+1, j) is the detail pixel;

wherein $G_1^{ref}$ is a first color grayscale threshold, $G_2^{ref}$ is a second color grayscale threshold, and $G_3^{ref}$ is a third color grayscale threshold.

According to an exemplary embodiment of the present disclosure, $G_1^{ref} \geq G_{max}/2$, $G_2^{ref} \geq G_{max}/2$, $G_3^{ref} \geq G_{max}/2$;

$G_{max}$ is a maximum value of color grayscale values of the image pixels.

According to an exemplary embodiment of the present disclosure, driving the screen pixels for display includes:

driving the screen pixel groups for display, wherein when a screen pixel group B(i, j) including a screen pixel P(i, j) and a screen pixel P(i, j+1) is driven for display, the screen pixel group B(i, j) is used to display one or more of an image pixel A(i, j) and an image pixel A(i, j+1) which are detail pixels;

wherein:

$1 \leq i \leq I$ and i is an integer;

I is a total number of rows of the image pixels;

$1 \leq j \leq J-1$, and j is an integer;

J is a total number of columns of the image pixels;

P(i, j) is a screen pixel in i-th row and j-th column;

P(i, j+1) is a screen pixel in i-th row and (j+1)-th column;

A(i, j+1) is an image pixel in i-th row and j-th column; and

A(i, j+1) is an image pixel in i-th row and (j+1)-th column.

According to a second aspect of the present disclosure, there is provided a driver for driving a display device. The display device includes a plurality of screen pixels arranged in an array, the plurality of screen pixels include a plurality of first screen pixels and a plurality of second screen pixels, each of the first screen pixels includes a first sub-screen pixel and a second sub-screen pixel, and each of the second screen pixels includes a first sub-screen pixel and a third sub-screen pixel.

In any screen pixel row, first screen pixels and second screen pixels are alternately arranged, individual first sub-screen pixels are arranged along a straight line, and a second sub-screen pixel or a third sub-screen pixel is arranged between any two adjacent first sub-screen pixels.

In any screen pixel column, first screen pixels and second screen pixels are alternately arranged, and individual first sub-screen pixels are arranged along a straight line.

The driver includes:

an image data obtaining circuit configured to obtain image data, wherein the image data includes color parameters of image pixels corresponding to the plurality of screen pixels one to one;

an analysis circuit configured to determine whether the image pixels are detail pixels according to the image data, wherein each of the detail pixels is an image pixel for displaying a single pixel dot pattern or a single pixel line pattern;

a mapping circuit configured to determine a plurality of screen pixel groups, wherein any one of the screen pixel groups includes two of the screen pixels adjacently arranged in a same row, and a screen pixel corresponding to each of the detail pixels is in the screen pixel group; and a driving circuit configured to drive the screen pixels for display, wherein a first sub-screen pixel located between a second sub-screen pixel and a third sub-screen pixel in any one of the screen pixel groups is used for emitting light, and another first sub-screen pixel in the any one of the screen pixel groups does not emit light.

According to an exemplary embodiment of the present disclosure, the analysis circuit includes:

a first analysis sub-circuit configured to compare $G_1(i, j+1)$ with $G_1(i, j)$ and $G_1(i, j+2)$, compare $G_2(i, j+1)$ with $G_2(i, j)$ and $G_2(i, j+2)$, and compare $G_3(i, j+1)$ with $G_3(i, j)$ and $G_3(i, j+2)$;

wherein:

i is any integer between 1 and I;

I is a total number of rows of the image pixels;

j is any integer between 1 and J−2;

J is a total number of columns of the image pixels;

$G_1(i, j+1)$ is the first color grayscale value of an image pixel A(i, j+1) in i-th row and (j+1)-th column;

$G_2(i, j+1)$ is the second color grayscale value of the image pixel A(i, j+1);

$G_3(i, j+1)$ is the third color grayscale value of the image pixel A(i, j+1);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i, j+2)$ is the first color grayscale value of an image pixel A(i, j+2) in i-th row and (j+2)-th column;

$G_2(i, j+2)$ is the second color grayscale value of the image pixel A(i, j+2);

$G_3(i, j+2)$ is the third color grayscale value of the image pixel A(i, j+2);

a first determination sub-circuit configured to:

if at least one of $|G_1(i, j+1)-G_1(i, j)|>G_1^{ref}$, $|G_2(i, j+1)-G_2(i, j)|>G_2^{ref}$ and $|G_3(i, j+1)-G_3(i, j)|>G_3^{ref}$ is satisfied, and at least one of $|G_1(i, j+1)-G_1(i, j+2)|>G_1^{ref}$, $|G_2(i, j+1)-G_2(i, j+2)|>G_2^{ref}$ and $|G_3(i, j+1)-G_3(i, j+2)|>G_3^{ref}$ is satisfied, determine that the image pixel A(i, j+1) is the detail pixel; wherein $G_1^{ref}$ is a first color grayscale threshold, $G_2^{ref}$ is a second color grayscale threshold, and $G_3^{ref}$ is a third color grayscale threshold;

a second analysis sub-circuit configured to compare $G_1(i+1, j)$ with $G_1(i, j)$ and $G_1(i+2)$, compare $G_2(i+1, j)$ with $G_2(i, j)$ and $G_2(i+2, j)$, and compare $G_3(i+1, j)$ with $G_3(i, j)$ and $G_3(i+2, j)$;

wherein:

i is any integer between 1 and I−2;

j is any integer between 1 and J;

$G_1(i+1, j)$ is the first color grayscale value of an image pixel A(i+1, j) in (i+1)-th row and j-th column;

$G_2(i+1, j)$ is the second color grayscale value of the image pixel A(i+1, j);

$G_3(i+1, j)$ is the third color grayscale value of the image pixel A(i+1, j);

$G_1(i+2, j)$ is the first color grayscale value of an image pixel A(i+2, j) in (i+2)-th row and j-th column;

$G_2(i+2, j)$ is the second color grayscale value of the image pixel A(i+2, j);

$G_3(i+2, j)$ is the third color grayscale value of the image pixel A(i+2, j);

a second determination sub-circuit configured to:

if at least one of $|G_1(i+1, j)-G_1(i, j)|>G_1^{ref}$, $|G_2(i+1, j)-G_2(i, j)|>G_2^{ref}$ and $|G_3(i+1, j)-G_3(i, j)|>G_3^{ref}$ is satisfied, and at least one of $|G_1(i+1, j)-G_1(i+2, j)|>G_1^{ref}$, $|G_2(i+1, j)-G_2(i+2, j)|>G_2^{ref}$ and $|G_3(i+1, j)-G_3(i+2, j)|>G_3^{ref}$ is satisfied, determine that the image pixel A(i+1, j) is the detail pixel.

According to an exemplary embodiment of the present disclosure, the driving circuit is configured to:

drive the screen pixel groups for display, wherein when a screen pixel group B(i, j) including a screen pixel P(i, j) and a screen pixel P(i, j+1) is driven for display, the screen pixel group B(i, j) is used to display one or more of an image pixel A(i, j) and an image pixel A(i, j+1) which are detail pixels;

wherein:

$1 \le i \le I$ and i is an integer;

I is a total number of rows of the image pixels;

$1 \le j \le J-1$, and j is an integer;

J is a total number of columns of the image pixels;

P(i, j) is a screen pixel in i-th row and j-th column;

P(i, j+1) is a screen pixel in i-th row and (j+1)-th column;

A(i, j+1) is an image pixel in i-th row and j-th column; and

A(i, j+1) is an image pixel in i-th row and (j+1)-th column.

BRIEF DESCRIPTION OF THE DRAWINGS

The above-mentioned and other features and advantages of the present disclosure will become more apparent from the exemplary embodiments with reference to the accompanying drawings.

DETAILED DESCRIPTION

Figure 1:
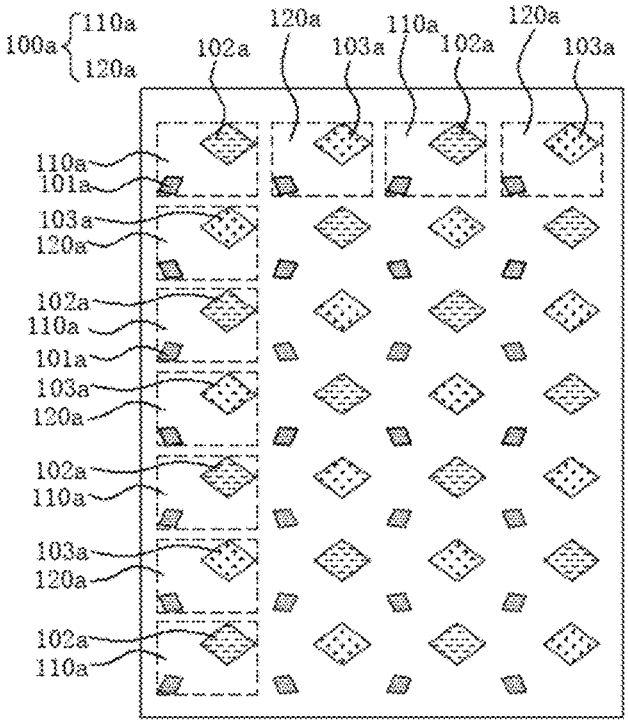
FIG. 1 is a schematic diagram showing an arrangement of screen pixels of a display device in related arts.

Example embodiments will now be described more fully with reference to the drawings. However, the example embodiments can be implemented in various forms, and should not be construed as being limited to the examples set forth herein; on the contrary, the provision of these embodiments makes the present disclosure more comprehensive and complete, and fully conveys the concept of the example embodiments to those skilled in the art. The described features, structures or characteristics can be combined in one or more embodiments in any suitable way. In the following description, details are shown to facilitate understanding of embodiments of the present disclosure.

In the drawings, the thickness of regions and layers may be exaggerated for clarity. The same reference signs in the drawing represent the same or similar structures, and repeated descriptions will be omitted.

The described features, structures or characteristics may be combined in one or more embodiments in any suitable manner. In the following description, many specific details are provided to give a sufficient understanding of embodiments of the present disclosure. However, those skilled in the art will realize that the technical solutions of the present disclosure can be practiced without one or more of the specific details, or other methods, components, materials, etc. can be used. In other cases, well-known structures, materials, or operations are not shown or described in detail to avoid obscuring the main technical ideas of the present disclosure. The terms "first" and "second" are used to distinguish different objects but should not be construed as constituting any limitation on the number of the objects.

Reference signs of main components in the drawings are listed as follows: 100*a*, screen pixels; 110*a*, first screen pixels; 120*a*, second screen pixels; 101*a*, green sub-screen pixels; 102*a*, red sub-screen pixels; 103*a*, blue sub-screen pixels; 100, screen pixels; 110, first Screen pixels; 120, second screen pixels; 101, first sub-screen pixels; 102, second sub-screen pixels; 103, third sub-screen pixels; 200, screen pixel groups; 400, driver for driving the display device; 410, image data obtaining circuit; 420, analysis circuit; 430, mapping circuit; and 440, driving circuit.

In the related art, referring to FIG. 1, a display device having a GRGB sub-pixel arrangement may include a plurality of screen pixels 100*a* arranged in an array. The screen pixels 100*a* include a plurality of first screen pixels 110*a* and a plurality of second screen pixels 120*a*. The first screen pixels 110*a* include green sub-screen pixels 101*a* and red sub-screen pixels 102*a*, and the second screen pixels 120*a* include green sub-screen pixels 101*a* and blue sub-screen pixels 103*a*. In any row of the screen pixels 100*a*, the first screen pixels 110*a* and the second screen pixels 120*a* are alternately arranged, the green sub-screen images 101*a* are arranged along a straight line, and a red sub-screen pixels 102*a* or a blue sub-screen pixels 103*a* is arranged between any two adjacent green sub-screen pixels 101*a*, and red sub-screen pixels 102*a* and blue sub-screen pixels 103*a* are arranged along a straight line. In any column of the screen pixels 100*a*, the first screen pixels 110*a* and the second screen pixels 120*a* are alternately arranged, the green sub-screen pixels 101*a* are arranged along a straight line, and the red sub-screen pixels 102*a* and the blue sub-screen pixel 103*a* are arranged along a straight line.

Figure 2:
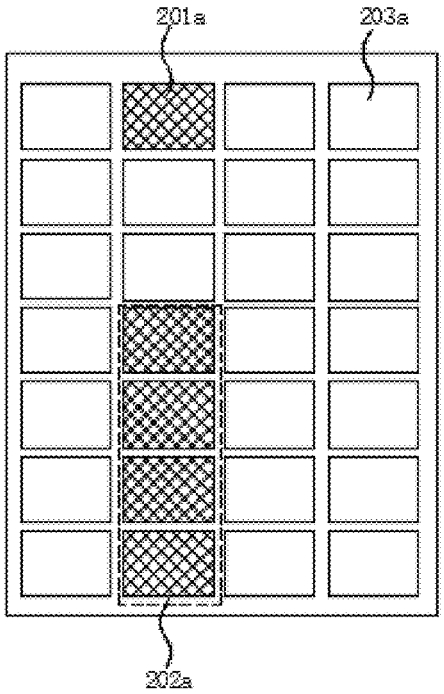
FIG. 2 is a schematic diagram showing an arrangement of an image pixel that needs to be lit and several image pixels which are adjacent to the image pixel and are in the same column with the image pixel in a BMP picture.
Figure 3:
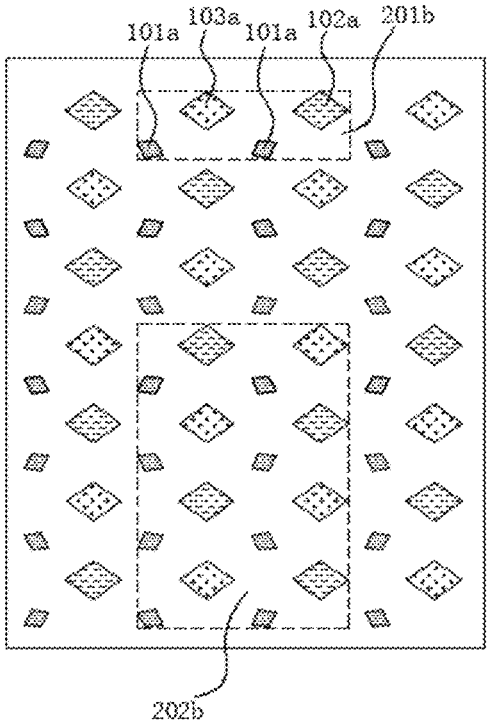
FIG. 3 is a schematic diagram showing sub-screen pixels which are turned on when a display device displays the BMP picture in FIG. 2 using a conventional SPR algorithm.

FIG. 2 is a schematic diagram showing an arrangement of an image pixel 201*a* that needs to be lit and several image pixels 2020*a* which are adjacent to the image pixel 201*a* and are in the same column with the image pixel 201*a* in a BMP picture. The image pixels 203*a* are image pixels that do not need to be lit and are located in an ineffective light-emitting area or a light leakage area. FIG. 3 is a schematic diagram showing sub-screen pixels which are turned on when a display device displays the BMP picture in FIG. 2 using a conventional SPR algorithm. Referring to FIG. 2 and FIG. 3, when an image pixel 201*a* in a BMP picture needs to be lit, the SPR algorithm causes the display device to light a group of sub-screen pixels 201*b*, and the group of sub-screen pixels 201*b* may include adjacent red sub-screen pixel 102*a* and blue sub-screen pixel 103*a*, and may also include two green sub-screen pixels 101*a*. The red sub-screen pixel 102*a* can display 100% of the red part required by the image pixel 201*a*, and the blue sub-screen pixel 103*a* displays 100% of the blue part required by the image pixel 201*a*, and each of the green sub-screen pixels 101*a* displays 50% of the green part required by the image pixel 201*a*. Referring to FIGS. 2 and 3, when multiple adjacent image pixels 202*a* in the same column in the BMP picture need to be lit, the SPR algorithm makes the display device light up a group of sub-screen pixels 202*b*, so that for any one image pixel, the SPR algorithm makes the display device light up a red sub-screen pixel 102*a* and a blue sub-screen pixel 103*a* which are adjacent with each other and two green sub-screen pixels 101*a*. In this way, the red sub-screen pixel 102*a* display 100% of the red part required by the image pixel, the blue sub-screen pixel 103*a* displays 100% of the blue part required by the image pixel, and each of the green sub-screen pixels 101*a* displays 50% of the green part required by the image pixel.

Figure 4:
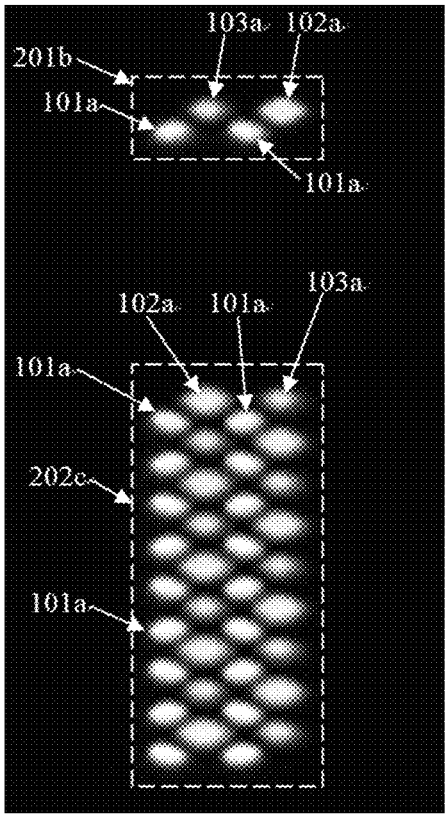
FIG. 4 is a display effect diagram when a display device displays one image pixel and several adjacent image pixels in the same column according to the conventional SPR algorithm.

FIG. 4 is a display effect diagram when a display device displays one image pixel and several adjacent image pixels in the same column according to the conventional SPR algorithm. Referring to FIG. 4, a group of sub-screen pixels

201*b* can be lit to display one image pixel; a group of sub-screen pixels 202*c* can be lit to display several adjacent image pixels in the same column. Any image pixel can be displayed by one red sub-screen pixel 102*a*, one blue sub-screen pixel 103*a* and two green sub-screen pixels 101*a*, and the light-emitting brightness of one green sub-screen pixel 101*a* is 50% of the required green brightness.

However, when displaying a single-pixel dot pattern or a single-pixel line pattern, for example when displaying fonts and lines, the green sub-screen pixels are located on one side of each screen pixel, and thus the single-pixel dot pattern or the single-pixel line pattern displayed by the display device may become greener on the one side of the single-pixel dot pattern or the single-pixel line pattern. On the other side, because the red sub-screen pixel generally have higher luminous efficiency than the blue sub-screen pixel, the other side of the single-pixel dot pattern or the single-pixel line pattern may become more red in contrast to the greener one side of the ingle-pixel dot pattern or the single-pixel line pattern. In addition, when the SPR algorithm performs pixel borrowing, the line displayed for the single-pixel line pattern will be thicker, which will affect the display effect. In addition, due to the high luminous efficiency of the green sub-screen pixels, the aperture ratio of the green sub-screen pixels is smaller than that of the red sub-screen pixels and blue sub-screen pixels, and the uniformity or evenness of the arrangement of the green sub-screen pixels is often not as high as the red sub-screen pixels and blue sub-screen pixels. Thus, when a single pixel line pattern is displayed using the SPR algorithm, the displayed image often has noticeable jaggedness.

Figure 5:
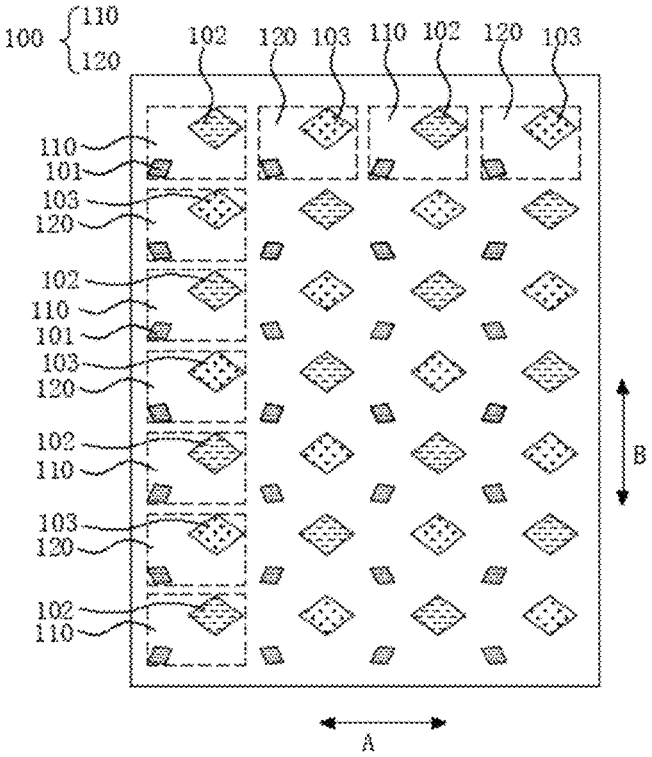
FIG. 5 is a schematic diagram showing an arrangement of screen pixels of a display device according to an embodiment of the present disclosure.

In order to improve the display effect of the display device, the present disclosure provides a method for driving the display device. As shown in FIG. 5, the display device includes a plurality of screen pixels 100 arranged in an array. The screen pixels 100 include a plurality of first screen pixels 110 and a plurality of second screen pixels 120. Each of the first screen pixels 110 includes one first sub-screen pixel 101 and one second sub-screen pixel 102. Each of the second screen pixels 120 includes one first sub-screen pixel 101 and one third sub-screen pixel 103. Along the row direction A, in any row of screen pixels 100, the first screen pixels 110 and the second screen pixels 120 are alternately arranged, the first sub-screen pixels 101 are arranged along a straight line, and a second sub-screen pixel 102 or a third sub-screen pixel 103 is arranged between any two adjacent first sub-screens pixels 101. Along the column direction B, in any column of screen pixels 100, the first screen pixels 110 and the second screen pixels 120 are alternately arranged, and the sub-screen pixels 101 are arranged along a straight line.

Figure 6:
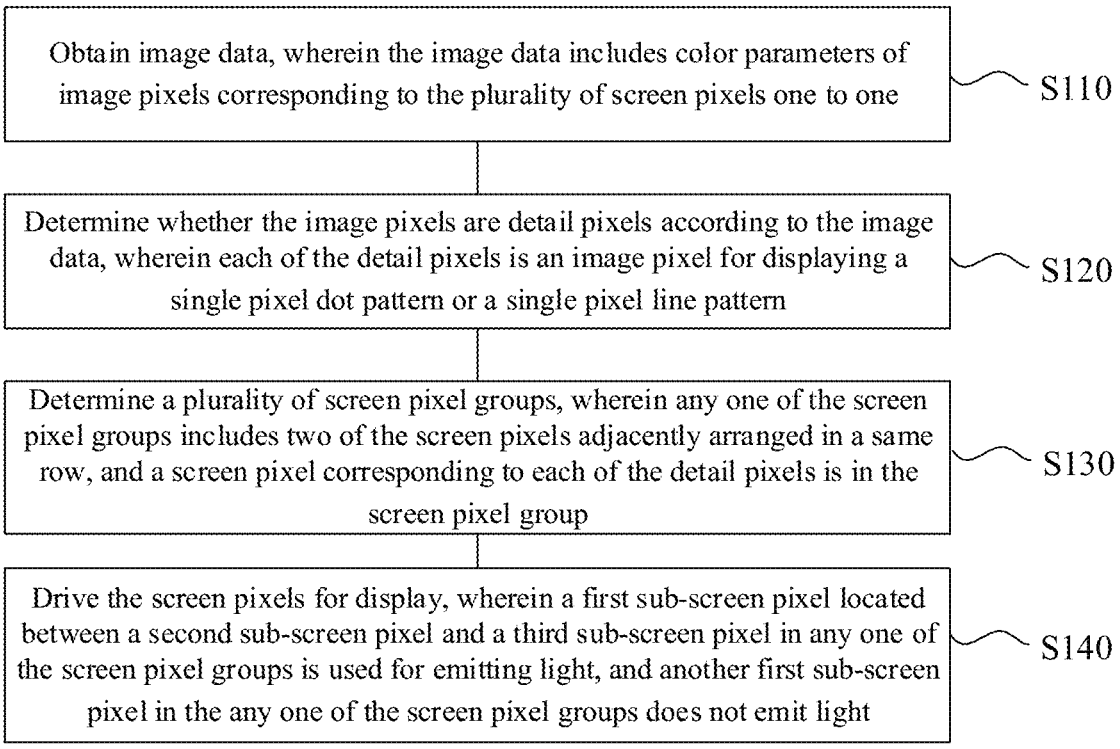
FIG. 6 is a schematic flowchart of a method for driving a display device according to an embodiment of the present disclosure.

As shown in FIG. 6, the method for driving the display device includes the following steps:

In step S110, image data is obtained. The image data includes color parameters of image pixels corresponding to the plurality of screen pixels 100 one to one.

In step S120, whether the image pixels are detail pixels is determined according to the image data. A detail pixel refers to an image pixel for displaying a single pixel dot pattern or a single pixel line pattern.

Figure 7:
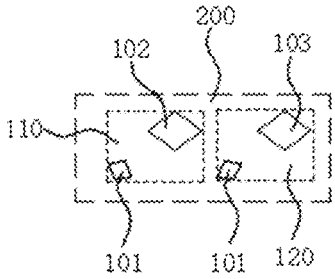
FIG. 7 is a schematic structural diagram of a screen pixel group according to an embodiment of the present disclosure.

In step S130, a plurality of screen pixel groups are determined. As shown in FIG. 7, any one of the screen pixel groups 200 includes two of the screen pixels 100 adjacently arranged in a same row, and a screen pixel 100 corresponding to each of the detail pixels is in the screen pixel group 200.

In step S110, the screen pixels 100 are driven for display. As shown in FIG. 7, a first sub-screen pixel 101 located between a second sub-screen pixel 102 and a third sub-screen pixel 103 in any one of the screen pixel groups 200 is used for emitting light, and the other first sub-screen pixel 101 in the any one of the screen pixel groups 200 does not emit light.

In the method for driving the display device according to embodiments of the present disclosure, detail pixels used for presenting a single pixel dot pattern or a single pixel line pattern are determined first, then a plurality of screen pixel groups 200 are determined according to the detail pixels, and the screen pixel groups 200 are used for displaying the detail pixels. In each of the screen pixel groups 200, a first sub-screen pixel 101 located between a second sub-screen pixel 102 and a third sub-screen pixel 103 is used to emit light, and the other first sub-screen pixel 101 in the screen pixel group 200 does not emit light. In this way, embodiments of the present disclosure can avoid color shift when the single pixel dot pattern or the single pixel line pattern is displayed caused by arranging the first sub-screen pixel 101 at one side of the screen pixel group 200. Also, because the first sub-screen pixel 101 located between the second sub-screen pixel 102 and the third sub-screen pixel 103 is used for 100% light emission while the other first sub-screen pixel 101 does not emit light, jaggedness resulted from uneven arrangement of the first sub-screen pixels 101 can be reduced, thereby improving the definition and fitness of the displayed single-pixel pattern or single-pixel line pattern.

Figure 8:
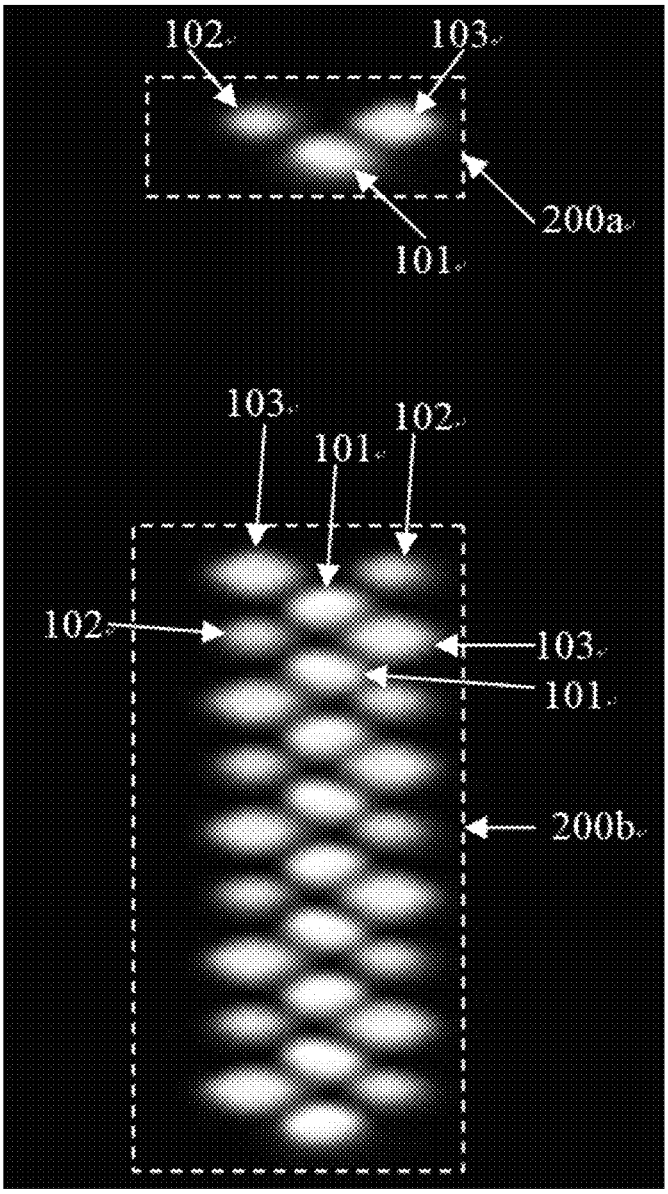
FIG. 8 is a display effect diagram of displaying one image pixel and several adjacent image pixels in the same column according to the driving method of embodiments of the present disclosure.

FIG. 8 is a display effect diagram of displaying one image pixel and several adjacent image pixels in the same column according to the method for driving the display device according to embodiments of the present disclosure. A screen pixel group 200*a* is used to display an image pixel. As shown in FIG. 8, only the first sub-screen pixel 101 arranged between the second sub-screen pixel 102 and the third sub-screen pixel 103 in the screen pixel group 200*a* emits light, the other first sub-screen pixel 101 does not emit light, and the first sub-screen pixel 101 that emits light is used to emit 100% of the required light instead of 50%. A set of adjacent screen pixel groups 200*b* in the same column are used to display several adjacent image pixels in the same column. As shown in FIG. 8, in the set of screen pixel groups 200*b*, only the first sub-screen pixels 101 between second sub-screen pixels 102 and the third sub-screen pixels 103 emit light.

Figure 9:
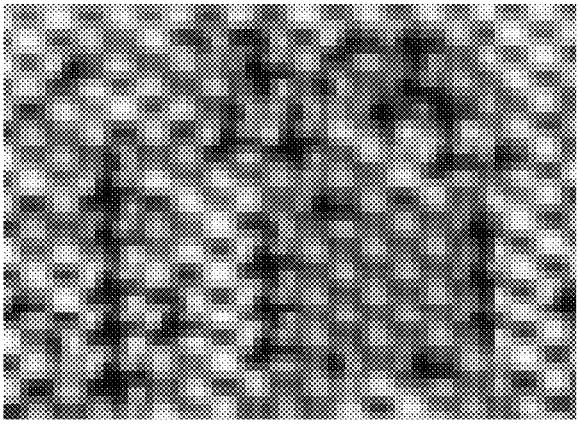
FIG. 9 is a diagram showing display effects when a Chinese character "鑽" is displayed using the existing SPR algorithm.
Figure 10:
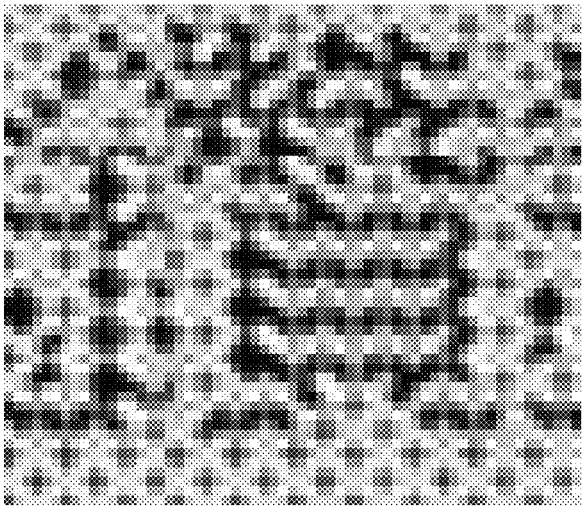
FIG. 10 is a diagram showing display effects when the display device displays the Chinese character "鑽" using the driving method of the display device according to embodiments of the present disclosure.

FIG. 9 is a diagram showing display effects when a Chinese character "鑽" is displayed using the existing SPR algorithm. As shown in FIG. 9, the displayed Chinese character "鑽" is not clear, and looks blurry. Also, the left side of the displayed Chinese character "鑽" is greener and the right side of the displayed Chinese character "鑽" is more red (FIG. 9 is a grayscale picture, the color effect of the picture cannot be effectively displayed). FIG. 10 is a diagram showing display effects when the display device displays the Chinese character "鑽" using the driving method of the display device according to embodiments of the present disclosure. As shown in FIG. 10, the displayed Chinese character "鑽" is clear, and there is no problem of color shift on the left and right sides. Therefore, the method for driving the display device according to embodiments of the present disclosure can significantly increase the clarity of displayed characters.

Figure 11:
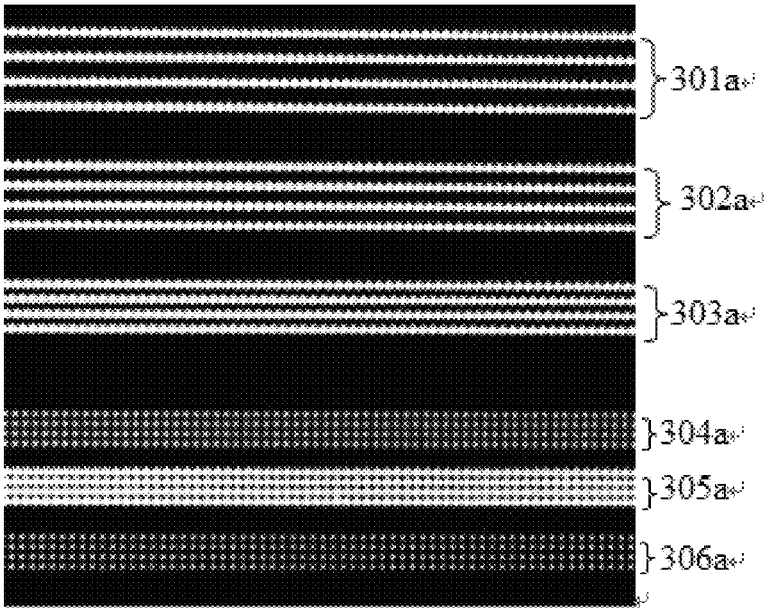
FIG. 11 is a diagram showing display effects when horizontal lines are displayed using the existing SPR algorithm.
Figure 12:
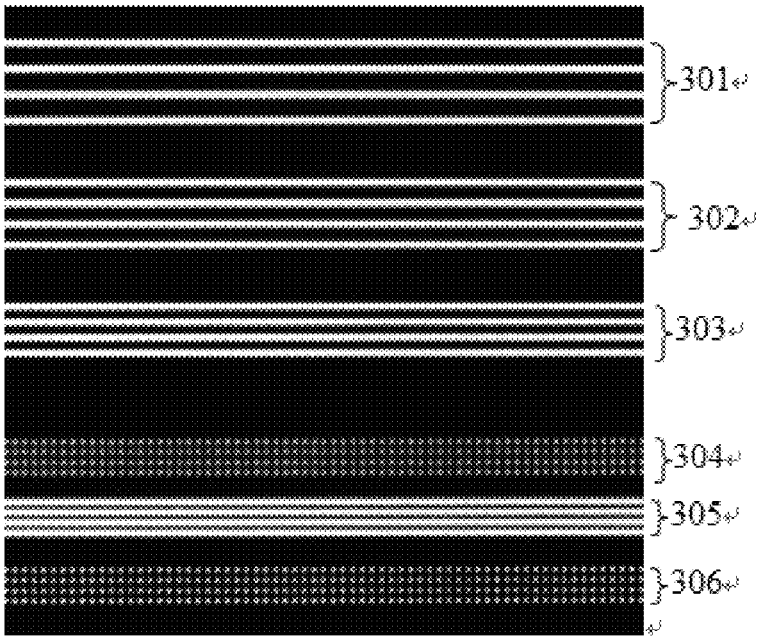
FIG. 12 is a diagram showing display effects when horizontal lines are displayed by the display device using the driving method provided by embodiments of the present disclosure.

FIG. 11 is a diagram showing display effects when horizontal lines are displayed using the existing SPR algorithm. Each of 301*a*, 302*a*, and 303*a* includes multiple lines. The difference between 301*a*, 302*a*, and 303*a* lies in that the distances between adjacent lines are different. As can be seen from 301*a*, 302*a*, and 303*a*, no matter how the distance between adjacent lines changes, the lines show noticeable jaggedness. The reference sign 304*a* shows the display effect when only the red sub-screen pixels are lit, the reference sign 306*a* shows the display effect when only the blue sub-screen pixels are lit, and the reference sign 305*a* shows the display effect when only the green sub-screen pixels are lit. As can be seen from 305*a*, when only green sub-screen pixels are lit, the pattern presents a noticeable jaggedness. FIG. 12 is a diagram showing display effects when horizontal lines are displayed by the display device using the driving method provided by embodiments of the present disclosure. Each of 301, 302, and 303 includes multiple lines, and the difference between 301, 302, and 303 lies in that the distances between adjacent lines are different. As can be seen from 301, 302 and 303, no matter how the distance between adjacent lines changes, the lines are smooth and delicate, and there is no obvious jaggedness. The reference sign 304 shows the display effect when only the second sub-screen pixels are lit, the reference sign 306 shows the display effect when only the third sub-screen pixels are lit, and the reference sign 305 shows the display effect when only the first sub-screen pixels are lit. It can be understood that since only one first sub-screen pixel in any screen pixel group emits light, and the other first sub-screen pixel does not emit light, only one of any two adjacent first sub-screen pixels set in the same row in 305 emits light. As can be seen from 305, when only the first sub-screen pixels are lit, the pattern is smooth and delicate, and there is no obvious jaggedness. Therefore, the method for driving the display device according to embodiments of the present disclosure can reduce the jaggedness generated when the first sub-screen pixels in the same row are lit, thereby improving the fineness of the horizontal lines.

Figure 13:
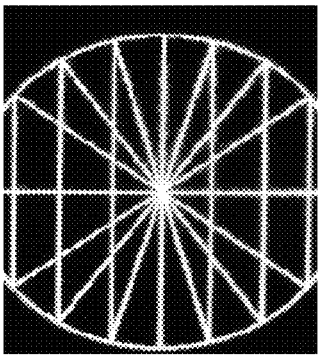
FIG. 13 is a diagram showing display effects when a line pattern is displayed using the existing SPR algorithm.
Figure 14:
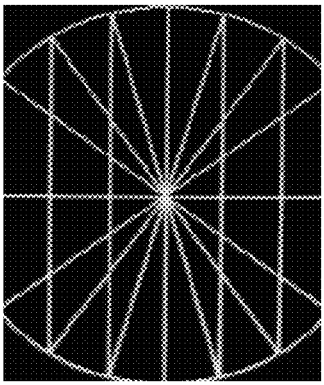
FIG. 14 is a diagram showing display effects when the same line pattern is displayed by the display device using the driving method provided by embodiments of the present disclosure.

FIG. 13 is a diagram showing display effects when a line pattern is displayed using the existing SPR algorithm. FIG. 14 is a diagram showing display effects when the same line pattern is displayed by the display device using the driving method provided by embodiments of the present disclosure. Comparing FIG. 13 and FIG. 14, it can be seen that the lines in FIG. 13 are rougher and the lines in FIG. 14 are more delicate. Therefore, the method for driving the display device according to embodiments of the present disclosure can improve the fineness of lines.

Hereinafter, the steps, principles, and effects of the method for driving the display device according to embodiments of the present disclosure will be described in detail.

The display device according to embodiments of the present disclosure may be an RGB display device. That is, the three types of sub-screen pixels may be red sub-screen pixels, green sub-screen pixels, and blue sub-screen pixels. In an embodiment of the present disclosure, the first sub-screen pixels 101 may be green sub-screen pixels, the second sub-screen pixels 102 may be red sub-screen pixels, and the third sub-screen pixels 103 may be blue sub-screen pixels. In any row of screen pixels 100, the second sub-screen pixels 102 and the third sub-screen pixels 103 can be alternately arranged along the same line; in any column of screen pixels 100, the second sub-screen pixels 102 and the third sub-screen pixels 103 may be alternately arranged along a straight line.

When displaying non-detail pixels, the display device according to embodiments of the present disclosure can display pictures or images using the SPR algorithm. When an image pixel needs to be displayed, the screen pixel 100 corresponding to the image pixel can borrow a sub-pixel from other screen pixels 100 arranged adjacently in the same row or arranged adjacently in the same column to display the image pixel. It is understandable that sub-pixels in the screen pixel 100 can also be borrowed by other screen pixels 100 to display other image pixels.

In step S110, the color parameters of the image pixels corresponding to the screen pixels 100 one to one are obtained. A color parameter of any one of the pixel images includes a first color grayscale value, a second color grayscale value, and a third color grayscale value.

According to embodiments, the first color can be close to the color that the first sub-screen pixels 101 can display, the second color can be close to the color that the second sub-screen pixels 102 can display, and the third color can be close to the color that the third sub-screen pixels 103 can display. For example, the first color can be green, and when the first sub-screen pixels 101 are lit, the first sub-screen pixels 101 can emit green light. The second color can be red, and when the second sub-screen pixels 102 are lit, the second sub-screen pixels 102 can emit red light. The third color may be blue, and when the third sub-screen pixels 103 are lit, the third sub-screen pixels 103 can emit blue light.

According to embodiments, the image pixels in the image data are in a one-to-one correspondence with the screen pixels 100. This means that any one image pixel corresponds to a screen pixel 100 having the same row and column coordinates as the one image pixel. For example, an image pixel A(i, j) and a screen pixel 100P(i, j) are an image pixel and a screen pixel 100 which correspond to each other. The image pixel A(i, j) is an image pixel in i-th row and j-th column. The screen pixel 100P(i, j) is a screen pixel 100 in i-th row and j-th column.

The driver for driving the display device may be provided with an image data obtaining circuit for obtaining image data. In an embodiment of the present disclosure, the image data obtaining circuit may include a data port and a data memory, the data port is used to receive externally input image data, and the data memory may receive and store the image data received by the data port directly or through a controller. Alternatively, the image data obtaining circuit may be implemented by other integrated ICs, and/or memories.

In an embodiment of the present disclosure, the image data may be in a BMP format.

In step S120, whether the image pixels are detail pixels may be determined according to the image data. A detail pixel is an image pixel used to display a single pixel dot pattern or a single pixel line pattern.

In embodiments of the present disclosure, the single-pixel dot pattern is a dot pattern, which has only one image pixel, and the pattern has a significant color difference from the surrounding patterns. The single-pixel line pattern is a line, and the width of the line is equal to one image pixel, and the pattern has a significant color difference from the surrounding patterns. Among the image pixels, the image pixels used to display the single pixel dot pattern or the single pixel line pattern are the detail pixels as referred to in embodiments of the present disclosure. When the SPR algorithm in related arts is used to display a single-pixel dot pattern or a single-pixel line pattern, the displayed pattern may have problems such as blurred patterns, jagged patterns, and color shifts in the row direction of the patterns.

Step S120 can be implemented by the following method:

In step S210, for any three adjacently arranged image pixels among the image pixels in each row, a color parameter of a middle image pixel which is in the middle of the three adjacently arranged image pixels is compared with color parameters of other two image pixels of the three adjacently arranged image pixels.

In step S220, if at least one of differences between the first color grayscale value, the second color grayscale value and the third color grayscale value of the middle image pixel and the first color grayscale value, the second color grayscale value and the third color grayscale value of a preceding image pixel satisfies a preset threshold, and at least one of differences between the first color grayscale value, the second color grayscale value and the third color grayscale value of the middle image pixel and the first color grayscale value, the second color grayscale value and the third color grayscale value of a following image pixel satisfies a preset threshold, the middle image pixel is determined as a detail pixel.

In step S230, for any three adjacently arranged image pixels among the image pixels in each column, a color parameter of a middle image pixel which is in the middle of the three adjacently arranged image pixels is compared with color parameters of other two image pixels of the three adjacently arranged image pixels.

In step S240, if at least one of differences between the first color grayscale value, the second color grayscale value and the third color grayscale value of the middle image pixel and the first color grayscale value, the second color grayscale value and the third color grayscale value of an upper image pixel satisfies a preset threshold, and at least one of differences between the first color grayscale value, the second color grayscale value and the third color grayscale value of the middle image pixel and the first color grayscale value, the second color grayscale value and the third color grayscale value of a lower image pixel satisfies a preset threshold, the middle image pixel is determined as a detail pixel.

According to embodiments, in step S210, $G_1(i, j+1)$ may be compared with $G_1(i, j)$ and $G_1(i, j+2)$, $G_2(i, j+1)$ may be compared with $G_2(i, j)$ and $G_2(i, j+2)$, and $G_3(i, j+1)$ may be compared with $G_3(i, j)$ and $G_3(i, j+2)$;

wherein:

i is any integer between 1 and I;

I is a total number of rows of the image pixels;

j is any integer between 1 and J−2;

J is a total number of columns of the image pixels;

$G_1(i, j+1)$ is the first color grayscale value of an image pixel A(i, j+1) in i-th row and (j+1)-th column;

$G_2(i, j+1)$ is the second color grayscale value of the image pixel A(i, j+1);

$G_3(i, j+1)$ is the third color grayscale value of the image pixel A(i, j+1);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i, j+2)$ is the first color grayscale value of an image pixel A(i, j+2) in i-th row and (j+2)-th column;

$G_2(i, j+2)$ is the second color grayscale value of the image pixel A(i, j+2);

$G_3(i, j+2)$ is the third color grayscale value of the image pixel A(i, j+2).

According to embodiments, in step S220, if at least one of $|G_1(i, j+1)-G_1(i, j)|>G_1^{ref}$, $|G_2(i, j+1)-G_2(i, j)|>G_2^{ref}$ and $|G_3(i, j+1)-G_3(i, j)|>G_3^{ref}$ is satisfied, and at least one of $|G_1(i, j+1)-G_1(i, j+2)|>G_1^{ref}|G_2(i, j+1)-G_2(i, j+2)|>G_2^{ref}$ and $|G_3(i, j+1)-G_3(i, j+2)|>G_3^{ref}$ is satisfied, the image pixel A(i, j+1) is determined as the detail pixel;

$G_1^{ref}$ is a first color grayscale threshold, $G_2^{ref}$ is a second color grayscale threshold, and $G_3^{ref}$ is a third color grayscale threshold.

According to embodiments, in step S230, $G_1(i+1, j)$ may be compared with $G_1(i, j)$ and $G_1(i+2)$, $G_2(i+1, j)$ may be compared with $G_2(i, j)$ and $G_2(i+2, j)$, and $G_3(i+1, j)$ may be compared with $G_3(i, j)$ and $G_3(i+2, j)$;

wherein:

i is any integer between 1 and I−2;

I is a total number of rows of the image pixels;

j is any integer between 1 and J;

J is a total number of columns of the image pixels;

$G_1(i+1, j)$ is the first color grayscale value of an image pixel A(i+1, j) in (i+1)-th row and j-th column;

$G_2(i+1, j)$ is the second color grayscale value of the image pixel A(i+1, j);

$G_3(i+1, j)$ is the third color grayscale value of the image pixel A(i+1, j);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i+2, j)$ is the first color grayscale value of an image pixel A(i+2, j) in (i+2)-th row and j-th column;

$G_2(i+2, j)$ is the second color grayscale value of the image pixel A(i+2, j);

$G_3(i+2, j)$ is the third color grayscale value of the image pixel A(i+2, j).

According to embodiments, in step S240, if at least one of $|G_1(i+1, j)-G_1(i, j)|>G_1^{ref}$, $|G_2(i+1, j)-G_2(i, j)|>G_2^{ref}$ and $|G_3(i+1, j)-G_3(i, j)|>G_3^{ref}$ is satisfied, and at least one of $|G_1(i+1, j)-G_1(i+2, j)|>G_1^{ref}$, $|G_2(i+1, j)-G_2(i+2, j)|>G_2^{ref}$ and $|G_3(i+1, j)-G_3(i+2, j)|>G_3^{ref}$ is satisfied, determining that the image pixel A(i+1, j) is the detail pixel;

$G_1^{ref}$ is a first color grayscale threshold, $G_2^{ref}$ is a second color grayscale threshold, and $G_3^{ref}$ is a third color grayscale threshold.

According to embodiments, the first color grayscale threshold $G_1^{ref}$, the second color grayscale threshold $G_2^{ref}$ and the third color grayscale threshold $G_3^{ref}$ may be same or different and embodiments of the present disclosure do not impose specific limitations on this.

According to embodiment, $G_1^{ref}\geq G_{max}/2$, $G_2^{ref}\geq G_{max}/2$, $G_3^{ref}\geq G_{max}/2$; wherein $G_{max}$ is a maximum value of color grayscale values of the image pixels. For example, if the number of grayscales of the image data is 10 bits, the maximum value of any color grayscale of the image pixels is 1023; correspondingly, the first color grayscale threshold, the second color grayscale threshold $G_2^{ref}$ and the third color grayscale threshold $G_3^{ref}$ may not be less than 512. In another example, if the number of grayscales of the image data is 8 bits, the maximum value of any color grayscale value of the image pixels is 255; correspondingly, the first color grayscale threshold, the second color grayscale threshold $G_2^{ref}$ and the third color grayscale threshold $G_3^{ref}$ may not be less than 128.

According to other embodiments, $G_1^{ref}\geq 0.75*G_{max}$, $G_2^{ref}\geq 0.75*G_{max}$, $G_3^{ref}\geq 0.75*G_{max}$.

The driver for driving the display device may be provided with an analysis circuit (Data Path). The analysis circuit can read the image data stored in the data memory directly or through a controller, so as to receive and analyze the image data to determine whether each image pixel is a detail pixel. According to embodiments, the analysis circuit may include a picture detection sub-circuit (IP module in an integrated circuit), and the picture detection sub-circuit is used to determine whether each image pixel is a detail pixel.

In step S130, screen pixel groups 200 may be determined according to determined detail pixels. Any screen pixel group 200 includes two adjacent screen pixels 100 in the same row, and the screen pixel 100 corresponding to each detail pixel is located in a screen pixel group 200.

For example, when it is determined that the image pixel A(i, j+1) is a detail pixel, the screen pixel 100 corresponding to the image pixel A(i, j+1) is the screen pixel 100P(i, j+1). In an embodiment of the present disclosure, the screen pixel 100P(i, j+1) and the screen pixel 100P(i, j) can be selected to form a screen pixel group 200B(i, j), which is used as the screen pixel group 200 for displaying the image pixel A(i, j+1). In another embodiment of the present disclosure, the screen pixel 100P(i, j+1) and the screen pixel 100P(i, j+2) can be selected to form a screen pixel group 200B(i, j+1), which is used as the screen pixel group 200 for displaying the image pixel A(i, j+1).

For another example, when it is determined that the image pixel A(i, j+1) and the image pixel A(i, j+2) are both detail pixels, the screen pixel 100 corresponding to the image pixel A(i, j+1) is the screen pixel 100P(i, j+1), and the screen pixel 100 corresponding to the image pixel A(i, j+2) is the screen pixel 100P(i, j+2). In an embodiment of the present disclosure, the screen pixel 100P(i, j+1) and the screen pixel 100P(i, j) can be selected to form a screen pixel group 200B(i, j) which is used as the screen pixel group 200 for displaying the image pixel A(i, j+1). The screen pixel 100P(i, j+2) and the screen pixel 100P(i, j+3) may be selected to form a screen pixel group 200B(i, j+2) which is used as a screen pixel group 200 for displaying the image pixel A(i, j+2). In this way, two adjacent image pixels in the same row can respectively correspond to two screen pixel groups 200, and each of the two adjacent image pixels can be displayed by a corresponding screen pixel group 200. In another embodiment of the present disclosure, the screen pixel 100P(i, j+1) and the screen pixel 100P(i, j+2) can be selected to form a screen pixel group 200B(i, j+1) which is used as the screen pixel group 200 for displaying the image pixel A(i, j+1) and the image pixel A(i, j+2). In this way, two adjacent image pixels in the same row can jointly correspond to the same screen pixel group 200 and be displayed by the same screen pixel group 200.

According to embodiments, the driver for driving the display device may be provided with a mapping circuit, which is used to determine a plurality of screen pixel groups 200. Any screen pixel group 200 includes two adjacent screen pixels 100 in the same row, and the screen pixel 100 corresponding to each detail pixel is located in the screen pixel group 200.

In step S140, screen pixels 100 can be driven for displaying image(s). When driving any screen pixel group 200, the first sub-screen pixel 101 located between the second sub-screen pixel 102 and the third sub-screen pixel 103 in the screen pixel group 200 is used for emitting light, and the other first sub-screen pixel 101 does not emit light.

According to embodiments, when screen pixels 100 are driven for display, the screen pixel group 200 is only used to display detail pixels. It can be understood that when two adjacent detail pixels in the same row correspond to the same screen pixel group 200, the screen pixel group 200 is used to display the two detail pixels.

For example, screen pixel groups 200 can be driven for display. When the screen pixel group 200B(i, j) including the screen pixel 100P(i, j) and the screen pixel 100P(i, j+1) is driven for display, the screen pixel group 200B(i, j) is only used to display one or more of the image pixel A(i, j) and the image pixel A(i, j+1) that are detail pixels. When only the image pixel A(i, j) is a detail pixel, the screen pixel group 200B(i, j) is only used to display the image pixel A(i, j). When only the image pixel A(i, j+1) is a detail pixel, the screen pixel group 200B(i, j) is only used to display the image pixel A(i, j+1). When the image pixel A(i, j) and the image pixel A(i, j+1) are both detail pixels, the screen pixel group 200B(i, j) is used to display the image pixel A(i, j) and the image pixel A(i, j+1).

In embodiments of the present disclosure, $1 \leq i \leq I$ and i is an integer; I is a total number of rows of the image pixels; $1 \leq j \leq J-1$, and j is an integer; J is a total number of columns of the image pixels; P(i, j) is a screen pixel 100 in i-th row and j-th column; P(i, j+1) is a screen pixel in i-th row and (j+1)-th column; A(i, j+1) is an image pixel in i-th row and j-th column; and A(i, j+1) is an image pixel in i-th row and (j+1)-th column.

Hereinafter, the method for driving the display device according to embodiments of the present disclosure will be described in conjunction with the following exemplary embodiments. In the exemplary embodiments, the display device may be a mobile phone screen, and the sub-pixels on the mobile phone screen may be arranged in diamonds. The method for driving the display device may include the following:

The image data obtaining circuit of the driver for driving the display device receives the image data of the m-th frame picture sent by the MCU (microprocessor) of the mobile phone. According to embodiments, the data port (MIPI) of the driver can receive image data in the BMP format transmitted by the MCU of the mobile phone, and then the image data can be stored in the data memory (Driver IC RAM) of the driver.

The analysis circuit of the driver for driving the display device determines whether the image pixels are detail pixels based on the image data. According to embodiments, before displaying the m-th frame picture, the analysis circuit (Data Path) of the driver reads the image data from the data memory, and the picture detection sub-circuit (IP module) of the analysis circuit determine whether individual image pixels are detail pixels according to differences between the first color grayscale values, the second color grayscale values and the third color grayscale values of adjacent image pixels to determine whether the image pixels are detail pixels. At this time, the display device displays the (m−1)-th frame picture. That is, during the displaying of the (m−1)-th frame picture, the driver make the determination regarding whether the image pixels are detail pixels. The mapping circuit of the driver for driving the display device can determine the screen pixel groups 200 corresponding to the detail pixels according to the detail pixels. A screen pixel group 200 is used to display the corresponding detail pixel (s).

The driving circuit of the driver for driving the display device drives each screen pixel 100 to display the m-th frame picture. During driving, each screen pixel 100 other than the screen pixel groups 200 can be driven according to the existing SPR algorithm, and each screen pixel group 200 can display one or more corresponding detail pixels.

The present disclosure also provides a driver 400 for driving a display device. The display device includes a plurality of screen pixels 100 arranged in an array. The screen pixels 100 include a plurality of first screen pixels 110 and a plurality of second screen pixels 120. Each of the first screen pixels 110 include a first sub-screen pixel 101 and a second sub-screen pixel 102, and each of the second screen pixels 120 include a first sub-screen pixel 101 and a third sub-screen pixel 103. In any row of screen pixels 100, the first screen pixels 110 and the second screen pixels 120 are alternately arranged, the first sub-screen pixels 101 are arranged along a straight line, and a second sub-screen pixel 102 or a third sub-screen pixel 103 is arranged between any two adjacent first sub-screen pixels 101. In any column of the screen pixels 100, the first screen pixels 110 and the second screen pixels 120 are alternately arranged (there may be intervals between the first screen pixels 110 and the second screen pixels 120), and the first sub-screen pixels 101 are arranged along a straight line.

Figure 15:
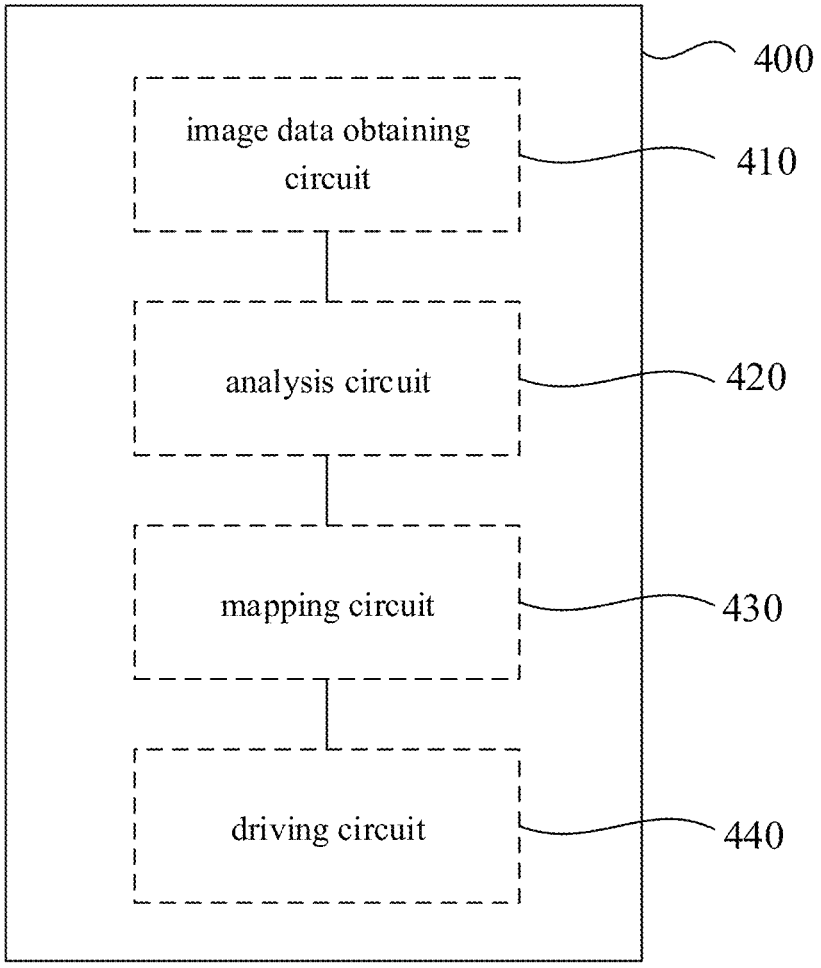
FIG. 15 is a schematic structural diagram of a driver for driving a display device according an embodiment of the disclosure.

As shown in FIG. 15, the driver 400 includes an image data obtaining circuit 410, an analysis circuit 420, a mapping circuit 430 and a driving circuit 440.

The image data obtaining circuit 410 is configured to obtain image data. The image data includes color parameters of image pixels corresponding to the plurality of screen pixels one to one.

The analysis circuit 420 is configured to determine whether the image pixels are detail pixels according to the image data. A detail pixel refers to an image pixel for displaying a single pixel dot pattern or a single pixel line pattern.

The mapping circuit 430 is configured to determine a plurality of screen pixel groups 200. Any one of the screen pixel groups 200 includes two of the screen pixels 100 adjacently arranged in a same row, and a screen pixel 100 corresponding to each of the detail pixels is in the screen pixel group 200.

The driving circuit 440 is configured to drive the screen pixels 100 for display. A first sub-screen pixel 101 located between a second sub-screen pixel 102 and a third sub-screen pixel 103 in any one of the screen pixel groups 200 is used for emitting light, and another first sub-screen pixel 101 in the any one of the screen pixel groups 200 does not emit light.

The driver for driving the display device according to embodiments of the present disclosure can implement any one of the methods for driving the display device as described above, and therefore has the same or similar beneficial effects. The principle and details of the driver for driving the display device according to embodiments of the present disclosure are described in detail in the method embodiments, or can be reasonably deduced according to the description of the method embodiments.

According to an embodiment of the present disclosure, the analysis circuit 20 includes a first analysis sub-circuit, a first determination sub-circuit, a second analysis sub-circuit and a second determination sub-circuit.

The first analysis sub-circuit is configured to compare $G_1(i, j+1)$ with $G_1(i, j)$ and $G_1(i, j+2)$, compare $G_2(i, j+1)$ with $G_2(i, j)$ and $G_2(i, j+2)$, and compare $G_3(i, j+1)$ with $G_3(i, j)$ and $G_3(i, j+2)$;

wherein:

i is any integer between 1 and I;

I is a total number of rows of the image pixels;

j is any integer between 1 and J−2;

J is a total number of columns of the image pixels;

$G_1(i, j+1)$ is the first color grayscale value of an image pixel A(i, j+1) in i-th row and (j+1)-th column;

$G_2(i, j+1)$ is the second color grayscale value of the image pixel A(i, j+1);

$G_3(i, j+1)$ is the third color grayscale value of the image pixel A(i, j+1);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i, j+2)$ is the first color grayscale value of an image pixel A(i, j+2) in i-th row and (j+2)-th column;

$G_2(i, j+2)$ is the second color grayscale value of the image pixel A(i, j+2);

$G_3(i, j+2)$ is the third color grayscale value of the image pixel A(i, j+2).

The first determination sub-circuit is configured to:

if at least one of $|G_1(i, j+1)-G_1(i, j)|>G_1^{ref}$, $|G_2(i, j+1)-G_2(i, j)|>G_2^{ref}$ and $|G_3(i, j+1)-G_3(i, j)|>G_3^{ref}$ is satisfied, and at least one of $|G_1(i, j+1)-G_1(i, j+2)|>G_1^{ref}$, $|G_2(i, j+1)-G_2(i, j+2)|>G_2^{ref}$ and $|G_3(i, j+1)-G_3(i, j+2)|>G_3^{ref}$ is satisfied, determine that the image pixel A(i, j+1) is the detail pixel; wherein $G_1^{ref}$ is a first color grayscale threshold, $G_2^{ref}$ is a second color grayscale threshold, and $G_3^{ref}$ is a third color grayscale threshold.

The second analysis sub-circuit is configured to compare $G_1(i+1, j)$ with $G_1(i, j)$ and $G_1(i+2)$, compare $G_2(i+1, j)$ with $G_2(i, j)$ and $G_2(i+2, j)$, and compare $G_3(i+1, j)$ with $G_3(i, j)$ and $G_3(i+2, j)$;

wherein:

i is any integer between 1 and I−2;

j is any integer between 1 and J;

$G_1(i+1, j)$ is the first color grayscale value of an image pixel A(i+1, j) in (i+1)-th row and j-th column;

$G_2(i+1, j)$ is the second color grayscale value of the image pixel A(i+1, j);

$G_3(i+1, j)$ is the third color grayscale value of the image pixel A(i+1, j);

$G_1(i+2, j)$ is the first color grayscale value of an image pixel A(i+2, j) in (i+2)-th row and j-th column;

$G_2(i+2, j)$ is the second color grayscale value of the image pixel A(i+2, j);

$G_3(i+2, j)$ is the third color grayscale value of the image pixel A(i+2, j).

The second determination sub-circuit is configured to:

if at least one of $|G_1(i+1, j)-G_1(i, j)|>G_1^{ref}$, $|G_2(i+1, j)-G_2(i, j)|>G_2^{ref}$ and $|G_3(i+1, j)-G_3(i, j)|>G_3^{ref}$ is satisfied, and at least one of $|G_1(i+1, j)-G_1(i+2, j)|>G_1^{ref}$, $|G_2(i+1, j)-G_2(i+2, j)|>G_2^{ref}$ and $|G_3(i+1, j)-G_3(i+2, j)|>G_3^{ref}$ is satisfied, determine that the image pixel A(i+1, j) is the detail pixel.

According to an embodiment, the driving circuit 440 is configured to:

drive the screen pixel groups 200 for display; wherein when a screen pixel group 200B(i, j) including a screen pixel 100P(i, j) and a screen pixel 100P(i, j+1) is driven for display, the screen pixel group 200B(i, j) is used to display one or more of an image pixel A(i, j) and an image pixel A(i, j+1) which are detail pixels;

wherein:

$1 \le i \le I$ and i is an integer; I is a total number of rows of the image pixels; $1 \le j \le J-1$, and j is an integer; J is a total number of columns of the image pixels; P(i, j) is a screen pixel 100 in i-th row and j-th column; P(i, j+1) is a screen pixel 100 in i-th row and (j+1)-th column; A(i, j+1) is an image pixel in i-th row and j-th column; and A(i, j+1) is an image pixel in i-th row and (j+1)-th column.

According to embodiments of the present disclosure, the image data obtaining circuit 410, the analysis circuit 420, the mapping circuit 430 and the driving circuit 440 may be implemented by one or more integrated circuits, and optionally with software instructions or commends for controlling the integrated circuits.

It should be noted that although various steps of the methods of the present disclosure are described in a specific order in the drawings, this does not require or imply that these steps must be performed in the specific order, or that all the steps shown must be performed to achieve the desired result. Additionally or alternatively, certain steps may be omitted, multiple steps may be combined into one step, and/or one step may be decomposed into multiple steps, etc., all such alternatives should be regarded as part of the present disclosure.

It should be understood that the present disclosure is not limited to the detailed structure and arrangement of components proposed in the description. The present disclosure can have other embodiments, and can be implemented and executed in various ways. The alternatives and modifications fall within the scope of the present disclosure. It should be understood that the present disclosure extends to all alternative combinations of two or more individual features mentioned in the description and/or drawings. All these different combinations constitute multiple alternative aspects of the present disclosure. Embodiments described herein illustrate the exemplary methods for implementing the present disclosure, and will enable those skilled in the art to utilize the present disclosure.

What is claimed is:

1. A method for driving a display device, comprising:

providing the display device, wherein:

the display device comprises a plurality of screen pixels arranged in an array, the plurality of screen pixels comprise a plurality of first screen pixels and a plurality of second screen pixels, each of the first screen pixels comprises a first sub-screen pixel and a second sub-screen pixel, and each of the second screen pixels comprises a first sub-screen pixel and a third sub-screen pixel;

in any screen pixel row, first screen pixels and second screen pixels are alternately arranged, individual first sub-screen pixels are arranged along a straight line, and a horizontal axis position of a second sub-screen pixel or a third sub-screen pixel is arranged between horizontal axis positions of any two adjacent first sub-screen pixels; and in any screen pixel column, first screen pixels and second screen pixels are alternately arranged, and individual first sub-screen pixels are arranged along a straight line;

obtaining image data, wherein the image data comprises color parameters of image pixels corresponding to the plurality of screen pixels one to one;

determining whether the image pixels are detail pixels according to the image data, wherein each of the detail pixels is an image pixel for displaying a single pixel dot pattern or a single pixel line pattern;

determining a plurality of screen pixel groups, wherein any one of the screen pixel groups comprises two of the screen pixels adjacently arranged in a same row, and a screen pixel corresponding to each of the detail pixels is in the screen pixel group; and driving the screen pixels for display, wherein a horizontal axis position of a first sub-screen pixel is located between horizontal axis positions of a second sub-screen pixel and a third sub-screen pixel in any one of the screen pixel groups, and the first sub-screen pixel is used for emitting light, and another first sub-screen pixel in the any one of the screen pixel groups does not emit light;

wherein obtaining image data comprises obtaining the color parameters of the image pixels corresponding to the screen pixels one to one, wherein a color parameter of any one of the pixel images comprises a first color grayscale value, a second color grayscale value, and a third color grayscale value; and wherein determining whether the image pixels are detail pixels according to the image data comprises:

for any three adjacently arranged image pixels among the image pixels in each row, comparing a color parameter of a middle image pixel which is in the middle of the three adjacently arranged image pixels with color parameters of other two image pixels of the three adjacently arranged image pixels;

if at least one of differences between the first color grayscale value, the second color grayscale value and the third color grayscale value of the middle image pixel and the first color grayscale value, the second color grayscale value and the third color grayscale value of a preceding image pixel satisfies a preset threshold, and at least one of differences between the first color grayscale value, the second color grayscale value and the third color grayscale value of the middle image pixel and the first color grayscale value, the second color grayscale value and the third color grayscale value of a following image pixel satisfies a preset threshold, determining that the middle image pixel is a detail pixel;

for any three adjacently arranged image pixels among the image pixels in each column, comparing a color parameter of a middle image pixel which is in the middle of the three adjacently arranged image pixels with color parameters of other two image pixels of the three adjacently arranged image pixels; and if at least one of differences between the first color grayscale value, the second color grayscale value and the third color grayscale value of the middle image pixel and the first color grayscale value, the second color grayscale value and the third color grayscale value of an upper image pixel satisfies a preset threshold, and at least one of differences between the first color grayscale value, the second color grayscale value and the third color grayscale value of the middle image pixel and the first color grayscale value, the second color grayscale value and the third color grayscale value of a lower image pixel satisfies a preset threshold, determining that the middle image pixel is a detail pixel.

2. The method according to claim 1, wherein for any three adjacently arranged image pixels among the image pixels in each row, comparing a color parameter of a middle image pixel which is in the middle of the three adjacently arranged image pixels with color parameters of other two image pixels of the three adjacently arranged image pixels comprises:

comparing $G_1(i, j+1)$ with $G_1(i, j)$ and $G_1(i, j+2)$, comparing $G_2(i, j+1)$ with $G_2(i, j)$ and $G_2(i, j+2)$, and comparing $G_3(i, j+1)$ with $G_3(i, j)$ and $G_3(i, j+2)$;

wherein:

i is any integer between 1 and I;

I is a total number of rows of the image pixels;

j is any integer between 1 and J−2;

J is a total number of columns of the image pixels;

$G_1(i, j+1)$ is the first color grayscale value of an image pixel A(i, j+1) in i-th row and (j+1)-th column;

$G_2(i, j+1)$ is the second color grayscale value of the image pixel A(i, j+1);

$G_3(i, j+1)$ is the third color grayscale value of the image pixel A(i, j+1);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i, j+2)$ is the first color grayscale value of an image pixel A(i, j+2) in i-th row and (j+2)-th column;

$G_2(i, j+2)$ is the second color grayscale value of the image pixel A(i, j+2);

$G_3(i, j+2)$ is the third color grayscale value of the image pixel A(i, j+2);

wherein if at least one of differences between the first color grayscale value, the second color grayscale value and the third color grayscale value of the middle image pixel and the first color grayscale value, the second color grayscale value and the third color grayscale value of a preceding image pixel satisfies a preset threshold, and at least one of differences between the first color grayscale value, the second color grayscale value and the third color grayscale value of the middle image pixel and the first color grayscale value, the second color grayscale value and the third color grayscale value of a following image pixel satisfies a preset threshold, determining that the middle image pixel is a detail pixel, comprises:

if at least one of $|G_1(i, j+1)-G_1(i, j)|>G_1^{ref}$, $|G_2(i, j+1)-G_2(i, j)|>G_2^{ref}$ and $|G_3(i, j+1)-G_3(i, j)|>G_3^{ref}$ is satisfied, and at least one of $|G_1(i, j+1)-G_1(i, j+2)|>G_1^{ref}$, $|G_2(i, j+1)-G_2(i, j+2)|>G_2^{ref}$ and $|G_3(i, j+1)-G_3(i, j+2)|>G_3^{ref}$ is satisfied, determining that the image pixel A(i, j+1) is the detail pixel;

wherein $G_1^{ref}$ is a first color grayscale threshold, $G_2^{ref}$ is a second color grayscale threshold, and $G_3^{ref}$ is a third color grayscale threshold.

3. The method for driving the display device according to claim 2, wherein $G_1^{ref} \geq G_{max}/2$, $G_2^{ref} \geq G_{max}/2$, $G_3^{ref} \geq G_{max}/2$; and wherein $G_{max}$ is a maximum value of color grayscale values of the image pixels.

4. The method according to claim 1, wherein for any three adjacently arranged image pixels among the image pixels in each column, comparing a color parameter of a middle image pixel which is in the middle of the three adjacently arranged image pixels with color parameters of other two image pixels of the three adjacently arranged image pixels, comprises:

comparing $G_1(i+1, j)$ with $G_1(i, j)$ and $G_1(i+2)$, comparing $G_2(i+1, j)$ with $G_2(i, j)$ and $G_2(i+2, j)$, and comparing $G_3(i+1, j)$ with $G_3(i, j)$ and $G_3(i+2, j)$;

wherein:

i is any integer between 1 and I−2;

I is a total number of rows of the image pixels;

j is any integer between 1 and J;

J is a total number of columns of the image pixels;

$G_1(i+1, j)$ is the first color grayscale value of an image pixel A(i+1, j) in (i+1)-th row and j-th column;

$G_2(i+1, j)$ is the second color grayscale value of the image pixel A(i+1, j);

$G_3(i+1, j)$ is the third color grayscale value of the image pixel A(i+1, j);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i+2, j)$ is the first color grayscale value of an image pixel A(i+2, j) in (i+2)-th row and j-th column;

$G_2(i+2, j)$ is the second color grayscale value of the image pixel A(i+2, j);

$G_3(i+2, j)$ is the third color grayscale value of the image pixel A(i+2, j);

wherein if at least one of differences between the first color grayscale value, the second color grayscale value and the third color grayscale value of the middle image pixel and the first color grayscale value, the second color grayscale value and the third color grayscale value of an upper image pixel satisfies a preset threshold, and at least one of differences between at least one of the first color grayscale value, the second color grayscale value and the third color grayscale value of the middle image pixel and the first color grayscale value, the second color grayscale value and the third color grayscale value of a lower image pixel satisfies a preset threshold, determining that the middle image pixel is a detail pixel, comprises:

if at least one of $|G_1(i+1, j)-G_1(i, j)|>G_1^{ref}$, $|G_2(i+1, j)-G_2(i, j)|>G_2^{ref}$ and $|G_3(i+1, j)-G_3(i, j)|>G_3^{ref}$ is satisfied, and at least one of $|G_1(i+1, j)-G_1(i+2, j)|>G_1^{ref}$, $|G_2(i+1, j)-G_2(i+2, j)|>G_2^{ref}$ and $|G_3(i+1, j)-G_3(i+2, j)|>G_3^{ref}$ is satisfied, determining that the image pixel A(i+1, j) is the detail pixel;

wherein $G_1^{ref}$ is a first color grayscale threshold, $G_2^{ref}$ is a second color grayscale threshold, and $G_3^{ref}$ is a third color grayscale threshold.

5. The method according to claim 1, wherein driving the screen pixels for display comprises:

driving the screen pixel groups for display, wherein when a screen pixel group B(i, j) comprising a screen pixel P(i, j) and a screen pixel P(i, j+1) is driven for display, the screen pixel group B(i, j) is used to display one or more of an image pixel A(i, j) and an image pixel A(i, j+1) which are detail pixels;

wherein:

$1 \leq i \leq I$ and i is an integer;

I is a total number of rows of the image pixels;

$1 \leq j \leq J-1$, and j is an integer;

J is a total number of columns of the image pixels;

P(i, j) is a screen pixel in i-th row and j-th column;

P(i, j+1) is a screen pixel in i-th row and (j+1)-th column;

A(i, j+1) is an image pixel in i-th row and j-th column; and

A(i, j+1) is an image pixel in i-th row and (j+1)-th column.

6. A driver for driving a display device, wherein the display device comprises a plurality of screen pixels arranged in an array, the plurality of screen pixels comprise a plurality of first screen pixels and a plurality of second screen pixels, each of the first screen pixels comprises a first sub-screen pixel and a second sub-screen pixel, and each of the second screen pixels comprises a first sub-screen pixel and a third sub-screen pixel;

wherein in any screen pixel row, first screen pixels and second screen pixels are alternately arranged, individual first sub-screen pixels are arranged along a straight line, and a horizontal axis position of a second sub-screen pixel or a third sub-screen pixel is arranged between horizontal axis positions of any two adjacent first sub-screen pixels;

wherein in any screen pixel column, first screen pixels and second screen pixels are alternately arranged, and individual first sub-screen pixels are arranged along a straight line;

wherein the driver comprises:

an image data obtaining circuit configured to obtain image data, wherein the image data comprises color parameters of image pixels corresponding to the plurality of screen pixels one to one;

an analysis circuit configured to determine whether the image pixels are detail pixels according to the image data, wherein each of the detail pixels is an image pixel for displaying a single pixel dot pattern or a single pixel line pattern;

a mapping circuit configured to determine a plurality of screen pixel groups, wherein any one of the screen pixel groups comprises two of the screen pixels adjacently arranged in a same row, and a screen pixel corresponding to each of the detail pixels is in the screen pixel group; and a driving circuit configured to drive the screen pixels for display, wherein a horizontal axis position of a first sub-screen pixel is located between horizontal axis positions of a second sub-screen pixel and a third sub-screen pixel in any one of the screen pixel groups, the first sub-screen pixel is used for emitting light, and another first sub-screen pixel in the any one of the screen pixel groups does not emit light;

wherein the image data obtaining circuit is further configured to obtain the color parameters of the image pixels corresponding to the screen pixels one to one, wherein a color parameter of any one of the pixel images comprises a first color grayscale value, a second color grayscale value, and a third color grayscale value; and wherein the analysis circuit is configured to:

for any three adjacently arranged image pixels among the image pixels in each row, compare a color parameter of a middle image pixel which is in the middle of the three adjacently arranged image pixels with color parameters of other two image pixels of the three adjacently arranged image pixels;

if at least one of differences between the first color grayscale value, the second color grayscale value and the third color grayscale value of the middle image pixel and the first color grayscale value, the second color grayscale value and the third color grayscale value of a preceding image pixel satisfies a preset threshold, and at least one of differences between the first color grayscale value, the second color grayscale value and the third color grayscale value of the middle image pixel and the first color grayscale value, the second color grayscale value and the third color grayscale value of a following image pixel satisfies a preset threshold, determine that the middle image pixel is a detail pixel;

for any three adjacently arranged image pixels among the image pixels in each column, compare a color parameter of a middle image pixel which is in the middle of the three adjacently arranged image pixels with color parameters of other two image pixels of the three adjacently arranged image pixels; and if at least one of differences between the first color grayscale value, the second color grayscale value and the third color grayscale value of the middle image pixel and the first color grayscale value, the second color grayscale value and the third color grayscale value of an upper image pixel satisfies a preset threshold, and at least one of differences between the first color grayscale value, the second color grayscale value and the third color grayscale value of the middle image pixel and the first color grayscale value, the second color grayscale value and the third color grayscale value of a lower image pixel satisfies a preset threshold, determine that the middle image pixel is a detail pixel.

7. The driver according to claim 6, wherein the analysis circuit is configured to:

compare $G_1(i, j+1)$ with $G_1(i, j)$ and $G_1(i, j+2)$, compare $G_2(i, j+1)$ with $G_2(i, j)$ and $G_2(i, j+2)$, and compare $G_3(i, j+1)$ with $G_3(i, j)$ and $G_3(i, j+2)$;

wherein:

i is any integer between 1 and I;

I is a total number of rows of the image pixels;

j is any integer between 1 and J−2;

J is a total number of columns of the image pixels;

$G_1(i, j+1)$ is the first color grayscale value of an image pixel A(i, j+1) in i-th row and (j+1)-th column;

$G_2(i, j+1)$ is the second color grayscale value of the image pixel A(i, j+1);

$G_3(i, j+1)$ is the third color grayscale value of the image pixel A(i, j+1);

$G_1(i, j)$ is the first color grayscale value of an image pixel A(i, j) in i-th row and j-th column;

$G_2(i, j)$ is the second color grayscale value of the image pixel A(i, j);

$G_3(i, j)$ is the third color grayscale value of the image pixel A(i, j);

$G_1(i, j+2)$ is the first color grayscale value of an image pixel A(i, j+2) in i-th row and (j+2)-th column;

$G_2(i, j+2)$ is the second color grayscale value of the image pixel A(i, j+2);

$G_3(i, j+2)$ is the third color grayscale value of the image pixel A(i, j+2);

if at least one of $|G_1(i, j+1)-G_1(i, j)|>G_1^{ref}$, $|G_2(i, j+1)-G_2(i, j)|>G_2^{ref}$ and $|G_3(i, j+1)-G_3(i, j)|>G_3^{ref}$ is satisfied, and at least one of $|G_1(i, j+1)-G_1(i, j+2)|>G_1^{ref}$, $|G_2(i, j+1)-G_2(i, j+2)|>G_2^{ref}$ and $|G_3(i, j+1)-G_3(i, j+2)|>G_3^{ref}$ is satisfied, determining that the image pixel A(i, j+1) is the detail pixel; wherein $G_1^{ref}$ is a first color grayscale threshold, $G_2^{ref}$ is a second color grayscale threshold, and $G_3^{ref}$ is a third color grayscale threshold.

8. The driver according to claim 7, wherein $G_1^{ref} \geq G_{max}/2$, $G_2^{ref} \geq G_{max}/2$, $G_3^{ref} \geq G_{max}/2$; and wherein $G_{max}$ is a maximum value of color grayscale values of the image pixels.

9. The driver according to claim 6, wherein the analysis circuit is configured to:

compare $G_1(i+1, j)$ with $G_1(i, j)$ and $G_1(i+2)$, compare $G_2(i+1, j)$ with $G_2(i, j)$ and $G_2(i+2, j)$, and compare $G_3(i+1, j)$ with $G_3(i, j)$ and $G_3(i+2, j)$;

wherein:

i is any integer between 1 and I−2;

j is any integer between 1 and J;

$G_1(i+1, j)$ is the first color grayscale value of an image pixel A(i+1, j) in (i+1)-th row and j-th column;

$G_2(i+1, j)$ is the second color grayscale value of the image pixel A(i+1, j);

$G_3(i+1, j)$ is the third color grayscale value of the image pixel A(i+1, j);

$G_1(i+2, j)$ is the first color grayscale value of an image pixel A(i+2, j) in (i+2)-th row and j-th column;

$G_2(i+2, j)$ is the second color grayscale value of the image pixel A(i+2, j);

$G_3(i+2, j)$ is the third color grayscale value of the image pixel $A(i+2, j)$;

if at least one of $|G_1(i+1, j)-G_1(i, j)|>G_1^{ref}$, $|G_2(i+1, j)-G_2(i, j)|>G_2^{ref}$ and $|G_3(i+1, j)-G_3(i, j)|>G_3^{ref}$ is satisfied, and at least one of $|G_1(i+1, j)-G_1(i+2, j)|>G_1^{ref}$, $|G_2(i+1, j)-G_2(i+2, j)|>G_2^{ref}$ and $|G_3(i+1, j)-G_3(i+2, j)|>G_3^{ref}$ is satisfied, determining that the image pixel $A(i+1, j)$ is the detail pixel.

10. The driver according to claim 6, wherein the driving circuit is configured to:

drive the screen pixel groups for display, wherein when a screen pixel group $B(i, j)$ comprising a screen pixel $P(i, j)$ and a screen pixel $P(i, j+1)$ is driven for display, the screen pixel group $B(i, j)$ is used to display one or more of an image pixel $A(i, j)$ and an image pixel $A(i, j+1)$ which are detail pixels;

wherein:

$1 \leq i \leq I$ and i is an integer;

I is a total number of rows of the image pixels;

$1 \leq j \leq J-1$, and j is an integer;

J is a total number of columns of the image pixels;

$P(i, j)$ is a screen pixel in i-th row and j-th column;

$P(i, j+1)$ is a screen pixel in i-th row and (j+1)-th column;

$A(i, j+1)$ is an image pixel in i-th row and j-th column; and $A(i, j+1)$ is an image pixel in i-th row and (j+1)-th column.

* * * * *